US006773355B1

(12) United States Patent
Lekhtman

(10) Patent No.: US 6,773,355 B1
(45) Date of Patent: Aug. 10, 2004

(54) WATER ENTERTAINMENT CENTER

(75) Inventor: David Lekhtman, Beaconsfield (CA)

(73) Assignee: Future Beach Corporation, Pointe-Claire (CA)

( * ) Notice: Subject to any disclaimer, the term of this patent is extended or adjusted under 35 U.S.C. 154(b) by 0 days.

(21) Appl. No.: 10/297,920

(22) PCT Filed: Jun. 18, 2001

(86) PCT No.: PCT/CA01/00907

§ 371 (c)(1),
(2), (4) Date: Dec. 20, 2002

(87) PCT Pub. No.: WO01/98605

PCT Pub. Date: Dec. 27, 2001

Related U.S. Application Data

(60) Provisional application No. 60/212,710, filed on Jun. 20, 2000.

(51) Int. Cl.[7] ..... A63G 31/00
(52) U.S. Cl. ..... 472/128; 472/129
(58) Field of Search ..... 472/117, 128, 472/129, 137; 405/70, 72

(56) References Cited

U.S. PATENT DOCUMENTS 2,761,155 A * 9/1956 Headley ..... 441/40
4,300,857 A * 11/1981 Santamaria ..... 405/70
4,598,904 A * 7/1986 Roth ..... 482/27
5,476,404 A * 12/1995 Price ..... 441/131
5,503,597 A * 4/1996 Lochtefeld et al. ..... 472/128
5,989,126 A * 11/1999 Kilbert et al. ..... 472/13

* cited by examiner

*Primary Examiner*—Kien Nguyen
(74) *Attorney, Agent, or Firm*—Ogilvy Renault

(57) ABSTRACT

A water entertainment assembly of shoreline mounted and floating water based modules releasably interconnected with edge joints, bridges, or strung along a flexible cord that is constructed on a beach or anchored to the sea floor in any selected configuration, including individual modules and assemblies for use as: deck platforms; shelters or kiosks; docks; playground equipment; parasols; bars; pool decks; seating areas; a swimming safety barrier, swimming spectator seating; floating dock platforms for various water based activities; containers for artificial grass and planters; floating spectator seating area; floating dock platform; floating platform for mounting various water activity accessories such as: a slide; a diving board; a ladder, bridge for spanning between adjacent platform modules; a lifeguard station; a trampoline; water area illumination; audio speakers; and a contoured seating surface.

19 Claims, 4 Drawing Sheets

WATER ENTERTAINMENT CENTER

This application claims the benefit of provisional application No. 60/212,710 filed Jun. 20, 2000.

TECHNICAL FIELD

The invention provides a water entertainment assembly of shoreline mounted and floating water based modules releasably interconnected with edge joints, bridges, or strung along a flexible cord that is constructed on a beach or anchored to the sea floor in any selected configuration, including individual modules and assemblies for use as: deck platforms; shelters or kiosks; docks; playground equipment; parasols; bars; pool decks; seating areas; a swimming safety barrier; swimming spectator seating; floating dock platforms for various water based activities; trampolines; containers for artificial grass and planters.

BACKGROUND OF THE ART

The shoreline areas of many beaches, resorts or parks include elevated decks, water access docks, playgrounds, shelters; gardens, swimming pools, lounge chairs, benches, parasols, kiosks for sale of products and providing services, bar or restaurant counters, equipment storage shelters, change room shelters, washrooms, showers and many other facilities to support the activity of visitors. In addition, floating strings of buoys are often used to separate safe swimming areas from the remainder of the shoreline beach area, to indicate the safe depth of water for children to swim in, and to indicate that the area is supervised by lifeguards. Generally, elevated deck structures and stationary dock structures are secured to the shore, while floating docks and buoyant floats are attached together and anchored in the water with leads to concrete blocks or the shoreline.

Beach areas are often used for rental and use of watercraft such as canoes, kayaks and water bicycles. The decks, docks and various floats may be used to moor the watercraft and separate swimming areas from areas where watercrafts are permitted or to restrict the area within watercraft may be operated.

Docks for mooring watercraft may also be anchored a distance from the shoreline and are used as swimming or diving platforms as well. Floating docks are used for mounting slides, sun-tanning lounges and other water based activities.

A disadvantage of the prior art systems is that physical and visual integration of various beach structures is not enabled by the various components. Often the docks, swimming float separators, lounge platforms, etc., are individually purchased are not visually or operationally integrated with each other. The lack of integration detracts from the appearance of the recreational area with a rather disorganized collection, and does not benefit from the cost reduction in maintaining and purchasing interchangeable modular components.

As well, such recreational areas are often used for various races, sporting or entertainment activities where temporary structures are erected in different arrangements at various times for various functions. There is often a desire to witness such activities from within the water. However to date no convenient means to accommodate spectators has been provided apart from conventional docks or associated walk way structures.

It is an object of the invention to provide a modular system of common components for assembly in water entertainment centers, which can be integrated and reorganized at the will of a designer.

It is also an object of the invention to provide floating spectator seating assemblies to enable spectators to watch water sports or other water based activities from within the water rather that being restricted to the beach areas or docks.

Further objects of the invention will be apparent from review of the disclosure and description of the invention below.

DISCLOSURE OF THE INVENTION

The invention provides water entertainment assembly, comprising a plurality of modules, each module having releasable connecting surfaces matching the releasable connecting surfaces of a mating module and each module have a service surface, the modules selected from the group consisting of: land mountable deck modules; buoyant dock modules; bridge modules; shelter mounting modules; planter modules; playground modules; swimming pool deck modules; and buoyant water surface mounted modules. Accessory mounts in the service surface of the platform module, permits attachment of platform accessories selected from the group consisting of: a slide: sandbox; climbing bars; roofed shelter; tent; storage cabinet; service counter; a diving board; a ladder; bridge means comprising a bridge for spanning between adjacent platform modules; a parasol; a lifeguard station; a trampoline; illumination means; audio speaker means; planter box; artificial grass layer; seating; and a bench.

The invention provides a water based assembly of interconnected buoyant seat modules strung along a flexible cord together with buoyant platform modules anchored in any selected configuration, to simultaneously serve as: a swimming safety barrier; floating spectator seating area; floating dock platform; floating platform for mounting various water activity accessories such as: a slide; a diving board; a ladder; bridge for spanning between adjacent platform modules; an umbrella; a lifeguard station; a trampoline; water area illumination; audio speakers; and a contoured seating surface. For low cost, lightweight, and aesthetic design features, preferably the modules and accessories are all formed as hollow rotary moulded plastic bodies although other materials such as fibreglass are equally applicable.

Further details of the invention and its advantages will be apparent from the detailed description and drawings included below.

BRIEF DESCRIPTION OF THE DRAWINGS

In order that the invention may be readily understood, one preferred embodiment of the invention will be described by way of example, with reference to the accompanying drawings wherein.

DETAILED DESCRIPTION OF PREFERRED EMBODIMENTS

Figure 1:
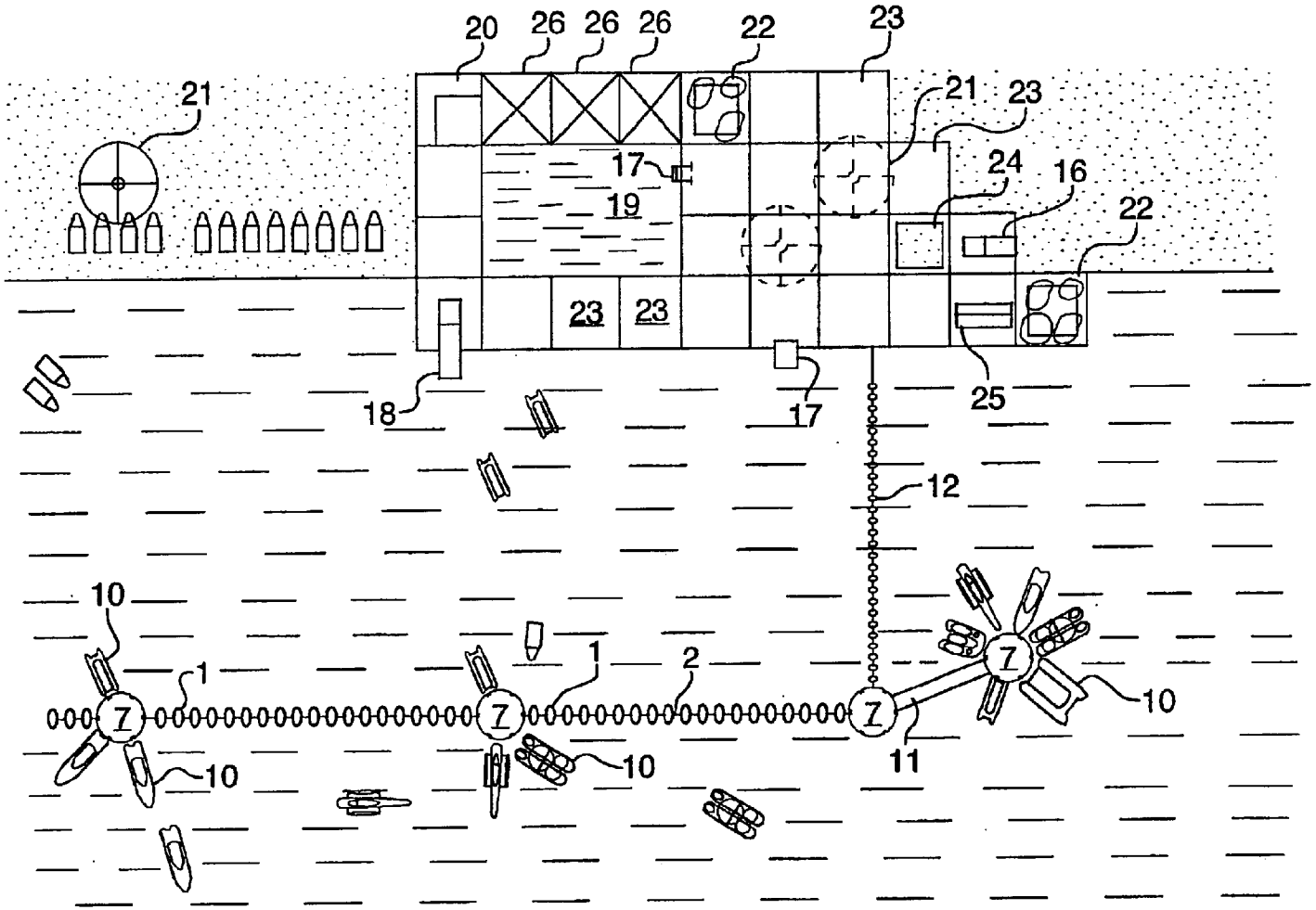
FIG. 1 is an aerial view of a beach area showing square deck modules; planter modules; shelter mounting modules; and oval seat modules disposed in an interconnected spaced apart swimming barrier array along a flexible cord with floating disc platforms serving as docks for mooring watercraft and swimming.

FIG. 1 shows an aerial view of a beach area that would be found at a resort hotel along a lake or ocean beachfront, for example. The water entertainment assembly includes several different modules that each has releasable connecting surfaces that match releasable connecting surfaces on mating modules. Various sizes and shapes of modules can be easily designed to equal advantage however in the embodiment illustrated, the use of square and round modules is used to simplify the description only.

The shore mounted deck assembly has square modules with connecting side surfaces that can be joined together with flanges and bolts or with sliding tongue and groove joints for example. The top surface of the deck modules 23 serves as a walking or sun tanning surface. The top surface of the buoyant dock modules 7 and bridge modules 11 serve for walking and swimming activities. The top surface of shelter mounting modules 26 have connectors for mounting kiosks, change rooms, or tent roofs. The planter modules 22 have a recessed top surface forming a planter area for gardens or securing artificial grass for example. Around the pool 19, a periphery of pool deck modules 23 provides a pool deck area.

The modules can include a number of different accessories mounted thereon such as a slide 16: sandbox 24; climbing bars (not shown); roofed shelter 26; tent; storage cabinet; service counter; a diving board 18; a ladder 17; a bridge 11 spanning between adjacent dock platform modules 7; a parasol 21; a lifeguard station; a trampoline; illumination means; audio speaker means; planter box 24; artificial grass layer; seating 25; and a bench 20.

As illustrated, the floating water entertainment assembly can include a variety of interconnected buoyant modules 1, 7 with anchoring means for anchoring the assembly in any desired configuration. It will be understood that the illustrated configuration shows a conventional rectangular shape, but any desired shape can be formed of the modular components with adequate anchoring arrangements.

Figure 4:
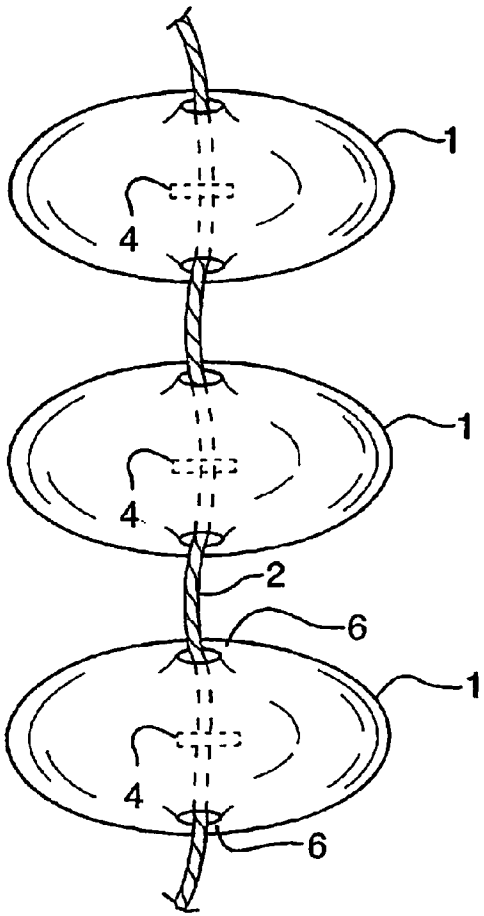
FIG. 4 is a top view of three interconnected seating modules showing a flexible cord passing through the handles and anchoring tab to join adjacent seating modules in a spaced apart array.
Figure 2:
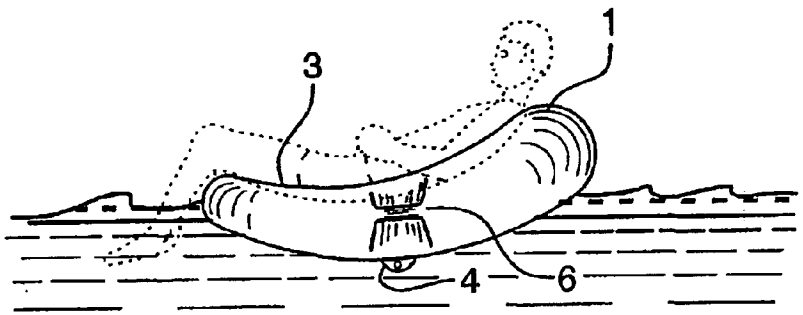
FIG. 2 is a side view of a seat module showing the anchoring tab protruding from the bottom, including side handles and a contoured top seating or lounge surface.
Figure 3:
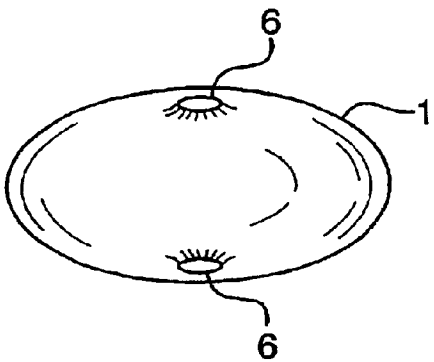
FIG. 3 is a top view of the seating module of FIG. 2.

With particular reference to FIGS. 2, 3, and 4, the water entertainment assembly includes a string of seat modules 1 disposed in an interconnected spaced apart array along a flexible cord 2. Each seat module 1 has a contoured top seating surface 3. The relatively large seating modules 1 serve a dual purpose therefore providing a physical and visual barrier for designating swimming areas or supervised beach areas while simultaneously providing spectator seating for various water sports or water based activities. Preferably, each seat module 1 is molded in a hollow rotary molded plastic body shape. The simple shape of the seat modules 1 enables stacking for shipping and storage as well as providing economical lightweight inexpensive spectator seating and water support separation areas.

Figure 7:
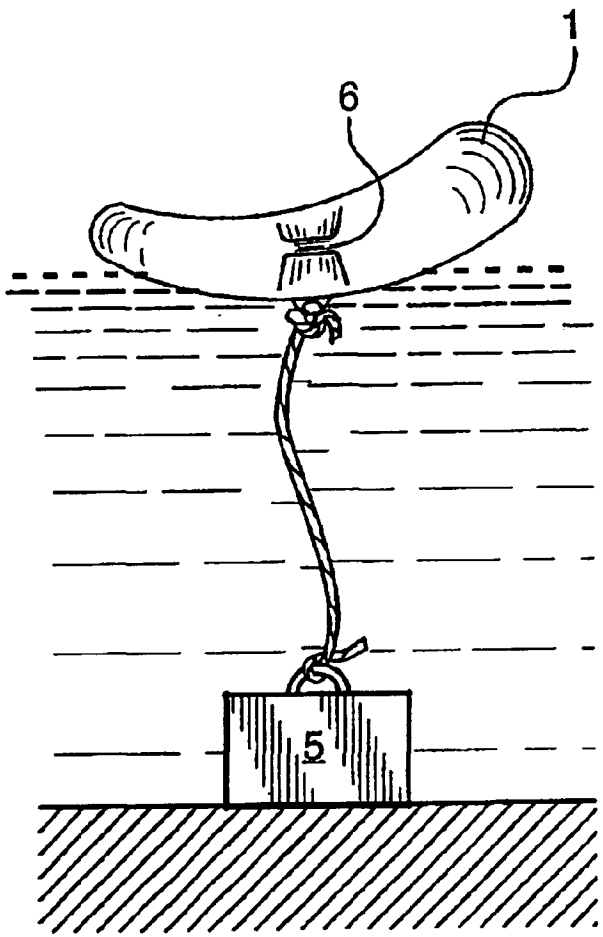
FIG. 7 is a side view of a floating seating module with anchor and lead connected to the anchoring tab protruding from the bottom of the seating module.

As indicated in FIG. 7, the seating modules 1 also include an anchor mounting tab 4 for securing the seat module array to an anchor 5. Together with the lateral handles 6, the seating modules 1 may be arranged together by passing the flexible cord 2 through each handle 6 and the anchor mounting tab 4 as indicated in FIG. 4. The handles 6 also provide, convenient grip for swimmers and enable the user to climb onto the seating module 1 and assume a comfortable seated position as indicated in FIG. 2.

Figure 5:
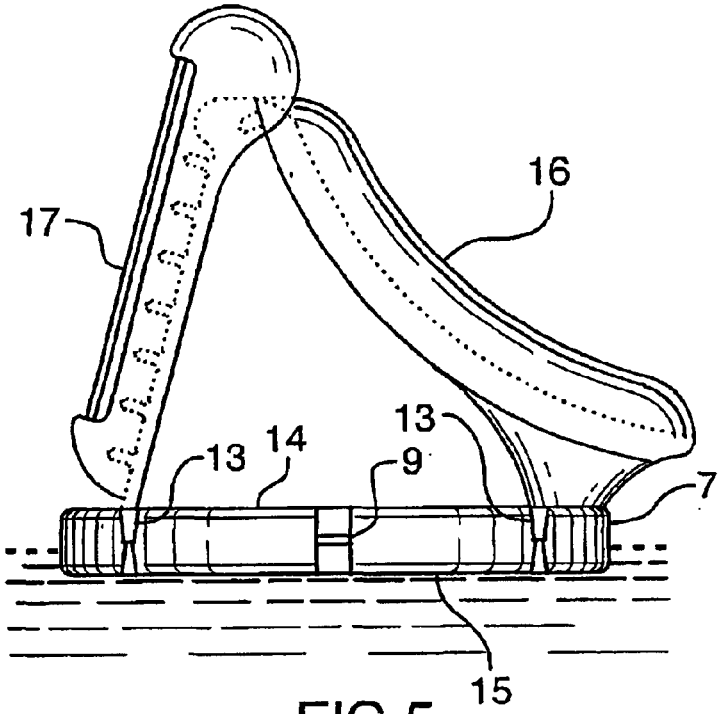
FIG. 5 is a side elevation view of a circular platform module with water slide mounted to sockets in the platform top surface, and peripheral mooring handles.
Figure 6:
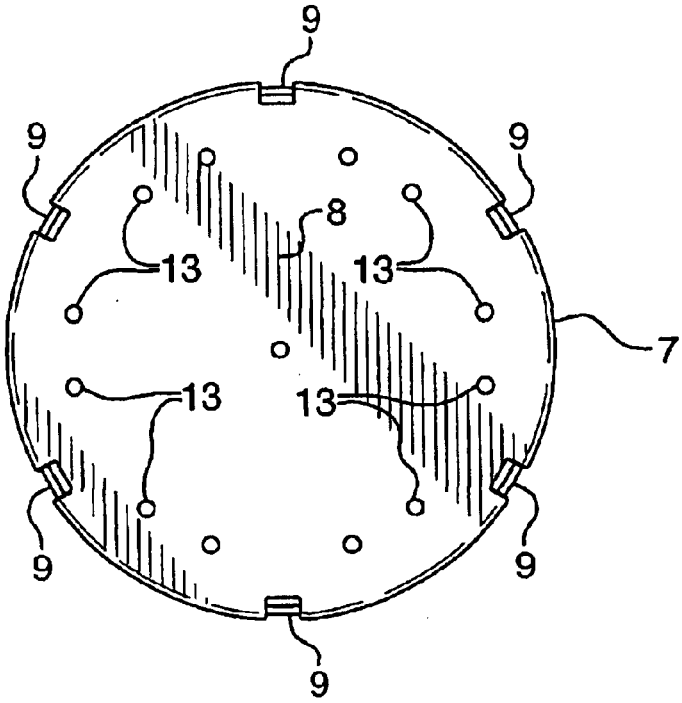
FIG. 6 is a top view of the circular platform module of FIG. 5 with slide removed.
Figure 8:
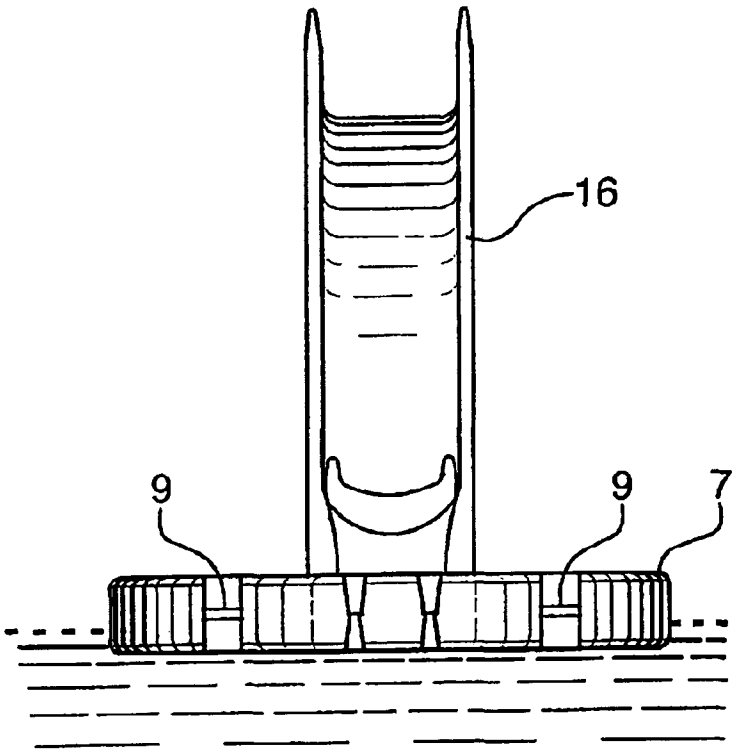
FIG. 8 is a front elevation view of the circular platform module with water slide of FIG. 5.

FIGS. 5, 6 and 8 show details of a like hollow rotary molded plastic platform module 7, in the embodiment illustrated having the shape of a relatively flat disc. However, it will be apparent that moulds for various shapes of platforms can be readily produced without departing from the teaching of the present invention. The platform module 7 may be produced in two identical semicircular components with a central joint 8 for ease of manufacture, storage, and transportation. Mooring handles 9 may be used to secure strings of seat modules 1, for example as shown in FIG. 1, and can also be used for mooring various watercraft 10 with appropriate mooring lines. As also indicated in FIG. 1, the mooring handles 10 can also be used for mounting a bridge 11 expanding between adjacent platform modules 7. A conventional string of separator buoys 12 can be used where seating modules 1 are not desired.

Referring in particular to FIGS. 6 and 5, the platform modules 7 include accessory mounting sockets 13 in the upper surface 14 and perform a variety of functions. For example, the empty accessory mounting sockets 13 serve to interconnect the top wall 14 and bottom wall 15 of the platform module 7, thereby structurally reinforcing the hollow plastic module 7 and preventing collapse of the top surface 14 under loading. Where accessory mounting sockets 13 pass straight through the module 7, they can also serve to drain any water that accumulates on the top surface 14.

However, as indicated in FIGS. 5 and 8, a primary function of the accessory mounting sockets is to mount various accessories such as the slide 16 and a ladder 17 shown. Other accessories that are not shown in the drawings but may be readily incorporated into the water entertainment assembly are a diving board, an umbrella or parasol, a lifeguard station, a trampoline, a chair or lounge, various illumination means such as battery or solar powered lights, and sound system components such as audio speakers, microphones, etc. In the event that the platform module 7 and seating modules 1 are used for boat races for example, the platform 7 can include lifeguard stations, announcer modules with sound systems, external lighting for nighttime use or internal illumination of translucent plastic components.

The modular construction of rotary molded plastic components with hollow plastic walls are easily removed for storage in off-season, and can be rearranged in various designs to introduce variety. The modules are light and easy to store or transport unlike conventional dock and swimming barrier structures.

Although the above description and accompanying drawings relate to a specific preferred embodiment as presently contemplated by the inventor, it will be understood that the invention in its broad aspect includes mechanical and functional equivalents of the elements described and illustrated.

I claim:

1. A water entertainment assembly, comprising a plurality of modules, each module having releasable connecting surfaces matching the releasable connecting surfaces of a mating module and each module have a service surface, the modules selected from the group consisting of: land mountable deck modules; buoyant dock modules; bridge modules;

shelter mounting modules; planter modules; playground modules; swimming pool deck modules; and buoyant water surface mounted modules; and wherein each module comprising a hollow moulded plastic body.

2. A water entertainment assembly according to claim 1, including a plurality of interconnected buoyant water surface mounted modules and anchoring means for anchoring the assembly in a selected configuration, the assembly comprising:

a plurality of seat modules disposed in an interconnected spaced apart array along a flexible cord, each seat module having a contoured seating surface.

3. A water entertainment assembly according to claim 2 including:

a buoyant platform module with at least one peripheral mooring mount securing an end of said cord.

4. A water entertainment assembly according to claim 3 wherein each module comprises a hollow rotary moulded plastic body.

5. A water entertainment assembly according to claim 3 wherein each platform module comprises a disc with mooring handles disposed about the periphery thereof.

6. A water entertainment assembly according to claim 2 including at least one said seat module with anchor mounting means for securing the seat module to an anchor.

7. A water entertainment assembly according to claim 2 including at least one said seat module with two lateral handles.

8. A water entertainment assembly according to claim 1 wherein each module comprises a hollow rotary moulded plastic body.

9. A water entertainment assembly according to claim 1 including at least one module with accessory mounts in the service surface.

10. A water entertainment assembly according to claim 9 including platform accessories selected from the group consisting of: a slide: sandbox; climbing bars; roofed shelter; tent; storage cabinet; service counter; a diving board; a ladder; bridge means comprising a bridge for spanning between adjacent modules; a parasol; a lifeguard station; a trampoline; illumination means; audio speaker means; planter box; artificial grass layer; seating; and a bench.

11. A water entertainment assembly, comprising a plurality of modules, each module having releasable connecting surfaces matching the releasable connecting surfaces of a mating module and each module have a service surface, the modules selected from the group consisting of: land mountable deck modules; buoyant dock modules; bridge modules; shelter mounting modules; planter modules; playground modules; swimming pool deck modules; and buoyant water surface mounted modules;

said water entertainment assembly including a plurality of interconnected buoyant water surface mounted modules and anchoring means for anchoring the assembly in a selected configuration, the assembly comprising:

a plurality of seat modules disposed in an interconnected spaced apart array along a flexible cord, each seat module having a contoured seating surface.

12. A water entertainment assembly according to claim 11 including:

a buoyant platform module with at least one peripheral mooring mount securing an end of said cord.

13. A water entertainment assembly according to claim 12 wherein each platform module comprises a disc with mooring handles disposed about the periphery thereof.

14. A water entertainment assembly according to claim 11 wherein each module comprises a hollow moulded plastic body.

15. A water entertainment assembly according to claim 11 including at least one said seat module with anchor mounting means for securing the seat module to an anchor.

16. A water entertainment assembly according to claim 11 including at least one said seat module with two lateral handles.

17. A water entertainment assembly according to claim 11 wherein each module comprises a hollow rotary moulded plastic body.

18. A water entertainment assembly according to claim 11 including at least one module with accessory mounts in the service surface.

19. A water entertainment assembly according to claim 18 including platform accessories selected from the group consisting of: a slide: sandbox; climbing bars; roofed shelter; tent; storage cabinet; service counter; a diving board; a ladder; bridge means comprising a bridge for spanning between adjacent modules; a parasol; a lifeguard station; a trampoline; illumination means; audio speaker means; planter box; artificial grass layer; seating; and a bench.

* * * * *